US005435468A

United States Patent [19]

Clark, II

[11] Patent Number: 5,435,468

[45] Date of Patent: Jul. 25, 1995

[54] REUSABLE VISCOUS MATERIAL DISPENSING APPARATUS

[75] Inventor: James E. Clark, II, Ojai, Calif.

[73] Assignee: Clark Technology Systems, Inc., Santa Paula, Calif.

[21] Appl. No.: 331,893

[22] Filed: Oct. 31, 1994

[51] Int. Cl.[6] ..... B67D 5/54

[52] U.S. Cl. ..... 222/389; 222/386

[58] Field of Search ..... 222/185, 386, 386.5, 222/387, 389, 444, 152

[56] References Cited

U.S. PATENT DOCUMENTS

| | | | |
|---|---|---|---|
| 3,099,370 | 7/1963 | Hein | 222/389 X |
| 3,321,110 | 5/1967 | Price | 222/389 |
| 3,403,818 | 10/1968 | Enssle | 222/389 X |
| 3,957,176 | 5/1976 | Marston | 222/389 X |
| 3,987,941 | 10/1976 | Blessing | 222/386 |
| 4,445,629 | 5/1984 | Doerfler | 222/389 X |
| 4,577,783 | 3/1986 | Racca et al. | 222/389 X |
| 4,938,377 | 7/1990 | Jarvis | 222/386 X |
| 5,248,069 | 9/1993 | Consaga et al. | 222/389 X |
| 5,297,702 | 3/1994 | Crosby et al. | 222/185 |
| 5,312,028 | 5/1994 | Hume | 222/389 X |

*Primary Examiner*—Kevin P. Shaver

*Attorney, Agent, or Firm*—I. Morley Drucker; Howard N. Sommers; Daniel R. Kimbell

[57] ABSTRACT

A reusable viscous material dispensing system. The system has a sealed pressure cylinder with a rounded upper region with an inert gas inlet, and a rounded bottom region with a viscous material ingress and egress opening. A pressurizing boat is contained in the cylinder. The pressurizing boat has a lower, hull portion which is weighted with ballast, and an upper portion. The lower, hull portion and upper portion join along a circular interface region. The diameter of the circular interface region is smaller than the inner diameter of the cylinder. The boat floats in the cylinder filled with viscous materials, such as thick lubricating greases. The viscous material forms a gaseous pressure seal between the interface region of the boat and inside of the pressure cylinder. Fins extend radially outwardly from the interface region of the pressurizing boat. These fins prevent the interface region from scraping viscous materials off the sidewalls of the pressure cylinder. In use of the system, the cylinder is filled with a viscous material through its ingress and egress opening. This raises the pressurizing boat and forms the gaseous pressure seal. By applying inert gas pressure to the pressurizing boat from above, the pressuring boat will force the viscous material out of the container through the viscous material ingress and egress opening, until the bottom of the boat seats on and blocks the ingress and egress opening.

16 Claims, 3 Drawing Sheets

FIG. 6
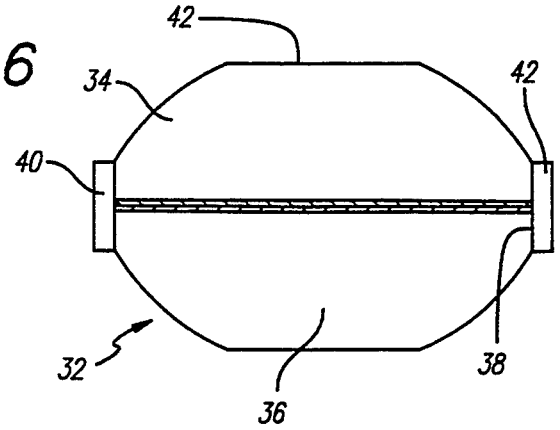
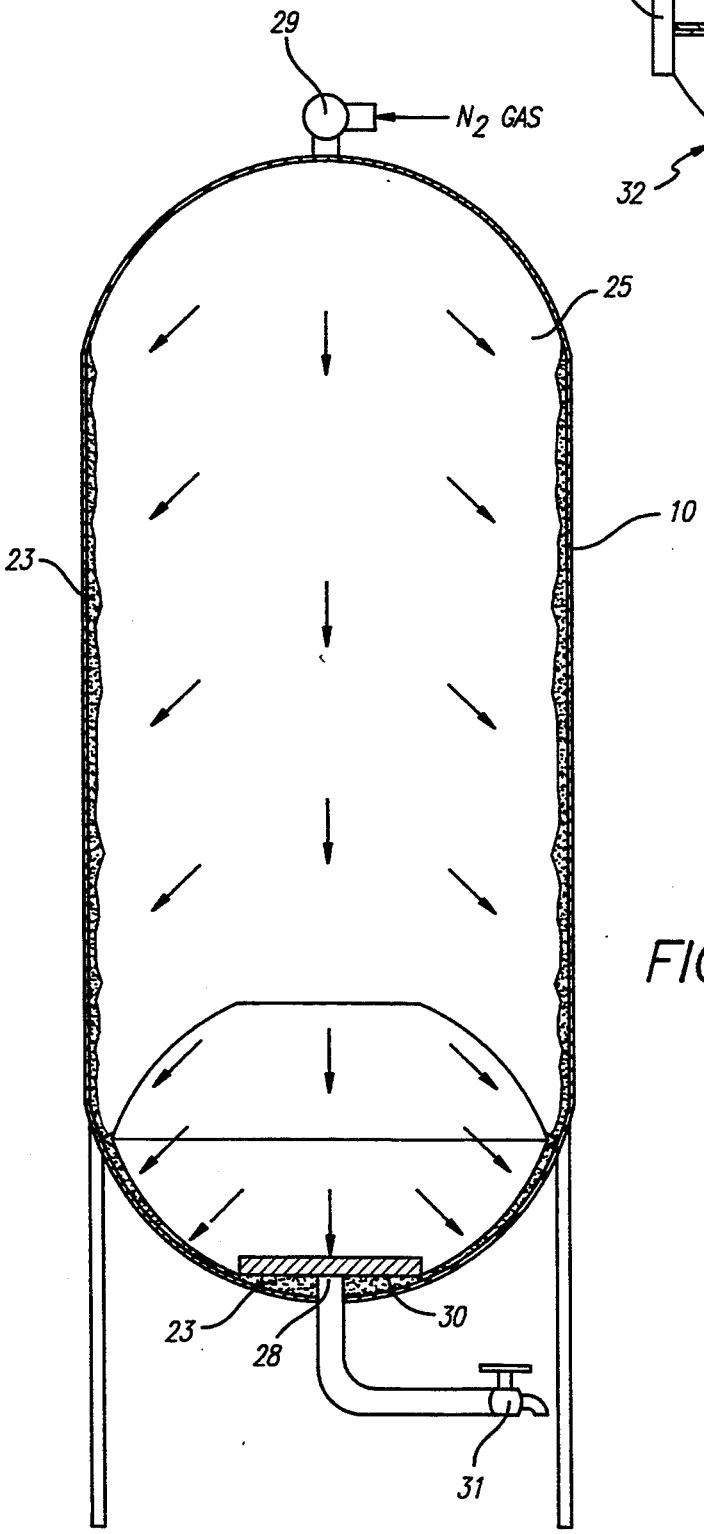
FIG. 3

REUSABLE VISCOUS MATERIAL DISPENSING APPARATUS

BACKGROUND OF THE INVENTION

1. Field of the Invention

This invention relates to the field of viscous material delivery systems, and more particularly to a sealed viscous material delivery and dispensing apparatus which is designed to be filled and emptied repeatedly without intervening cleaning of the apparatus, and which effectively delivers the vast majority of viscous material from the apparatus.

2. Description of the Prior Art

Vast amounts of viscous materials are used in transportation and industry. Thick, lubricating greases are used to lubricate vehicles and machinery, and thick, viscous chemicals are used in industry. In the food processing arts, cheeses, cream, food pastes and the like must be moved from point to point without excessively degrading the food's quality and freshness. In the manufacture of fine chemicals and pharmaceutical products, viscous materials are often used, and maintaining the quality of these viscous materials is of vital importance.

Delivering and dispensing viscous materials has always presented a challenge to manufacturers because these materials tend to stick to their containers and eventually coat the pumping machinery used to deliver the viscous materials. Prior art methods of delivery viscous fluids have concentrated on establishing and maintaining a fluid tight seal between pushing pistons or follower plates, and sidewalls of the containers of viscous materials. The devices of U.S. Pat. No. 5,248,069 to Consaga et al.; U.S. Pat. No. 5,297,702 to Crosby, et al.; and U.S. Pat. No. 5,312,028 to Hume are all directed to establishing a close seal.

These prior art devices, however, are highly susceptible to disruption if the sidewalls of the viscous material container becomes out of round or are dented. Moreover, the systems of Consaga et al. and Hume in particular, require high precision in all its parts, and require relatively bulky and expensive equipment.

There accordingly remains a need for a sealed system that uses relatively low cost components, which is repeatedly refillable without intervening cleaning and/or re-conditioning of the vessel, which is strong and durable, and which delivers a high percentage of the viscous material from the container.

BRIEF SUMMARY OF THE INVENTION

The invention further provides a reusable viscous material dispensing apparatus for use in dispensing thick viscous materials, from a sealed pressure container having sidewalls of generally cylindrical shape, an inert gas inlet at a top region, and a viscous material ingress and egress opening at a bottom region.

A pressurizing boat is located inside said sealed pressure container, said pressurizing boat having a lower hull portion and an upper hull portion. The lower hull portion and upper hull portion are preferably connected in a circular interface region which is smaller in diameter than the internal cross-sectional diameter of the cylindrical sealed pressure container, said pressurizing boat having means to prevent the circular interface region from directly contacting the inside of the sidewall of the cylindrical container.

In use of the system the container, when filled with viscous material through its ingress and egress opening, raises the pressurizing boat in the sealed pressure container and forms a viscous material seal between the interface region of the pressurizing boat and the inside of the sidewall of the container. By applying inert gas pressure to the pressurizing boat from above, the pressurizing boat will force the viscous material out of the container through the viscous material ingress and egress opening. The apparatus of the invention can be repeatedly refilled and reused without any intermediate cleaning or reconditioning of the container.

The invention further provides the reusable viscous material dispensing apparatus for use in dispensing viscous materials from a sealed pressure cylinder having a cylindrical body with sidewalls, a generally hemispherical upper end with an inert gas inlet, and a generally hemispherical lower end with an ingress and egress opening.

A pressurizing boat is contained inside the sealed pressure cylinder, said pressurizing boat having a lower, hull portion which is generally rounded in shape to conform to the shape of the generally hemispherical lower end of the pressure cylinder and an upper hull portion which is generally rounded in shape to conform to the shape of the generally hemispherical upper end of the pressure cylinder. The upper hull portion of the boat has a small orifice formed in a top portion thereof, said upper hull portion and lower hull portion being preferably connected together along a circular interface region which is smaller in diameter than the internal cross-sectional diameter of the cylindrical pressure container. The boat is weighted in its lower hull portion so that the weight of the viscous material displaced by its lowered, hull portion is about equal to the total weight of the boat. In this way, the pressurizing boat will float in the viscous material with the viscous material coming up to about its interface region. The boat has a plurality of fins extending radially outwardly from the vicinity of the interface region. These fins have narrow terminating points or edges which generally do not make contact with the inside surface of the sidewalls of the cylinder, and if they do, only make a slight scrape line of the viscous material the insides of the sidewalls of the cylinder, which scrape lines are readily filled in.

In the use of the system, the pressure cylinder is filled with viscous material through its ingress and egress opening, which raises the pressurizing boat in the pressure cylinder and forms a viscous material seal between the interface region and its fins, and the inside of the sidewalls of cylinders. By applying inert gas pressure to the pressurizing boat from above, the pressurizing boat will force the viscous material out of the container through the viscous material ingress and egress opening, all the while maintaining the seal between the pressuring boat and the inside of the sealed pressure cylinder.

Accordingly, it is an object of the present invention to provide a reversible and rechargeable system to deliver highly viscous materials from a sealed vessel; to provide a system which is robust and will function under harsh and abusive environments; to provide a system which is spillproof and safe to transport; and to provide a simple and low cost system.

BRIEF DESCRIPTION OF THE DRAWINGS

FIG. 3 is an exposed front view of the viscous material delivery system of the invention in its empty state.

FIG. 6 is a front view of an alternate embodiment of the floating boat of the invention.

DETAILED DESCRIPTION OF THE INVENTION

Figure 1:
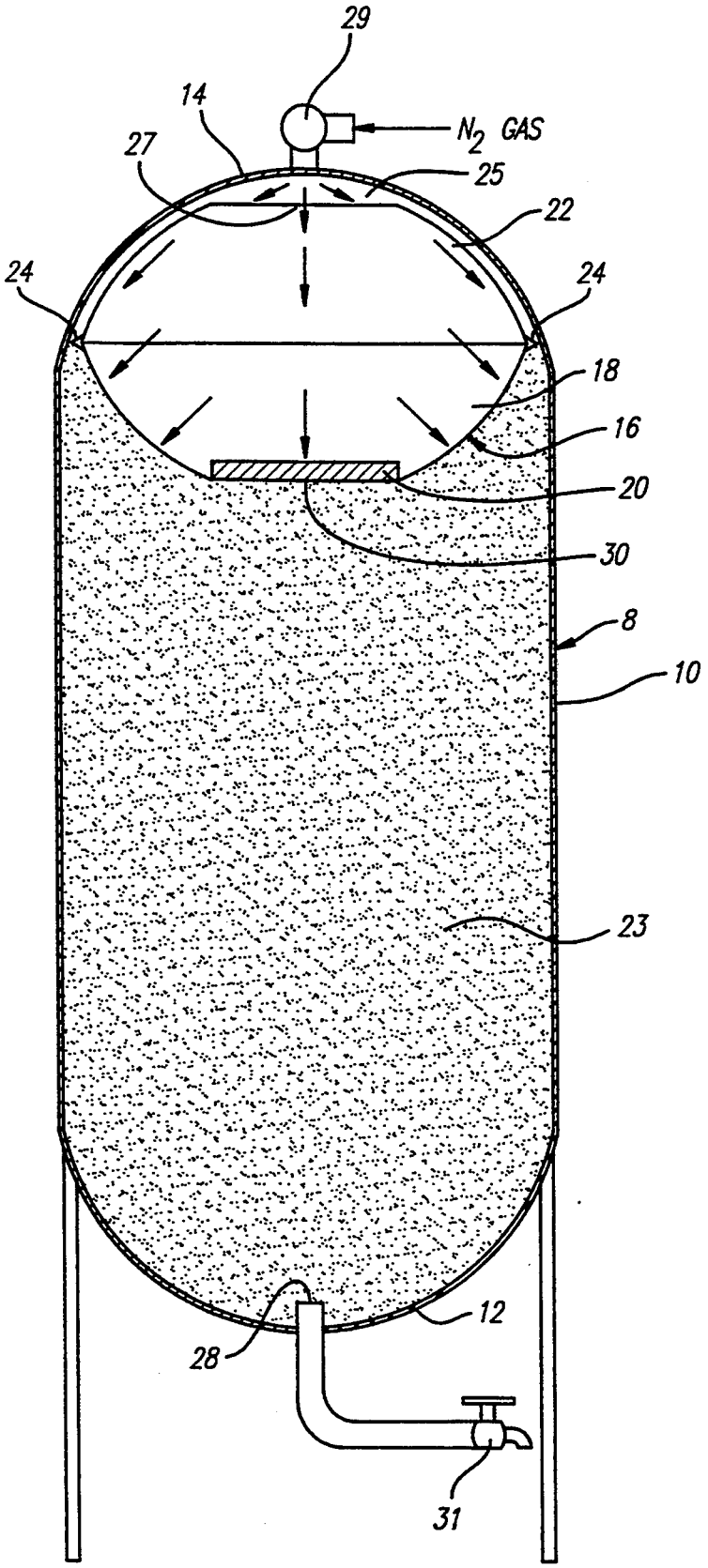
FIG. 1 is an exposed front view of a viscous material delivery system of the invention in its viscous material filled state.

Referring first to FIG. 1, the system uses a pressure cylinder 8 with sidewalls 10, with a rounded bottom 12 and a rounded top 14. Permanently located inside the cylinder 10 is a pressuring "boat" 16. The pressurizing boat 16 has a rounded lower hull 18, with ballast 20 located on the inside of its bottom wall 30. An upper hull portion 22 is located above the lower hull 18. The weight of the rounded lower hull 18, upper hull portion 22, and ballast 20 are calibrated to weigh approximately as much as the weight of the volume of viscous material displaced by the draft of the lower hull 18 of the boat 16. For many common viscous materials, such as thick industrial greases, the specific density is fairly uniform. In lieu of discrete ballast, by using thicker gauge material, the lower hull 18 can be made to be heavier than the upper hull portion.

Figure 2:
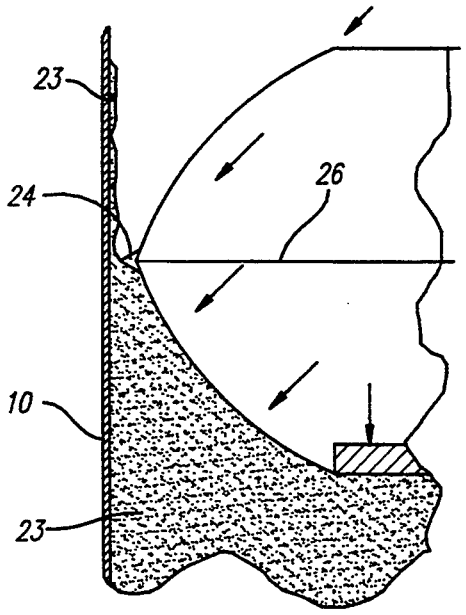
FIG. 2 is a detail illustrating the floating boat, the sidewall and the viscous material seal formed.

The boat 16 is sized to have a circular cross-section (see FIG. 4) which is smaller than that of the inner diameter of the cylinder 8. Referring to FIGS. 1 and 2, when the cylinder 12 is filled in its lower region with viscous material 23, and is pressured in its upper region 25 with inert gas such as $N_2$, the boat 16 will "float" on the viscous material, with the viscous material 23 level coming up to about the same level as the interface region 26 of rounded lower hull 18 and an upper hull portion 22 of the boat 16. The pressurized nitrogen gas is supplied to the cylinder via an inlet valve 29. For large cylinders, i.e. over 25 gallons, the nitrogen can be supplied under constant pressure i.e. by a nitrogen cylinder. For smaller cylinders, the cylinder can be charged with a predetermined volume of nitrogen, i.e. at 100 psi, and this will provide the motive forces to dispense the viscous material 23 from the cylinder.

The upper hull portion 22 of the boat 16 is illustrated as being rounded, but can have other shapes if desired. However, the rounded shape, with the weep hole 27 functions well and avoids any viscous material from entering the boat 16, but does allow the pressurizing boat 16 to become filled with pressurized inert gas.

Figure 4:
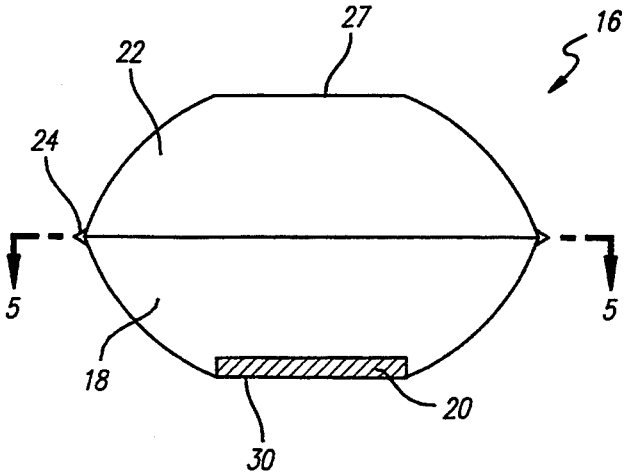
FIG. 4 is a front partially exposed view of the floating boat of the invention.
Figure 5:
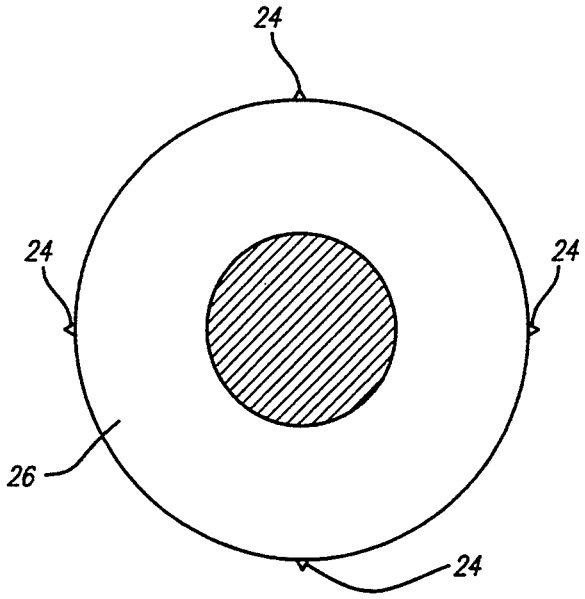
FIG. 5 is a cross-sectional view of the boat of FIG. 4 through view lines 5—5.

Referring to FIGS. 1–5, at least three fins 24 are located on the interface region 26 of the rounded bottom 18 and an upper portion 22 of the boat 16, and the fins 24 protrude outwardly by about ¼" (see FIGS. 4 and 5). Depending on which particular viscous material is being delivered by the system, the spacing between the interface region 26 of the boat 16 and the sidewalls 10 of the cylinder 8 can be optimized to form a sufficient seal. The fin 24 size will also need to be adjusted. These fins 24 are present to prevent the boat's 16 interface region 26 from scraping the viscous material 23 off of the sidewalls 10 of the cylinder 8. In normal operation, the fins 24 will mostly not make contact the sidewalls 10 of the cylinders 8. Even when there is contact between the fins 24 and the sidewall 10, at most, the fins 24 will make very narrow scrape lines on the viscous material 23 coating the sidewall 10 (not shown), which will quickly fill in due to the pressurization of the viscous material 23.

Referring to FIG. 2, the interface region 26 of the boat 16 and cylinder sidewalls 10 lie sufficiently close, but not touching, such that the viscous material 23 itself creates a gaseous pressure seal with the boat 16. The nitrogen gas pressure exerted on the boat 16, and the weight of the boat 16 will thus push the viscous material 23 downwardly and out of a bottom opening 28 in the cylinder's bottom region 12.

Referring to FIGS. 1 and 4, a small weep hole 27 is formed in the top of the upper hull portion 22 of the boat 16. This weep hole 27 permits the space inside the boat 16 to fill with pressurized nitrogen gas so that the cylinder 8 can always be charged with the maximum volume of nitrogen gas.

Referring to FIG. 3, when the cylinder 8 is nearly depleted of the viscous material 23, the bottom surface 30 of the boat 16 will seat on the bottom opening 28, and will seal it off, so no more of the viscous material 23, and no $N_2$ gas is released, even if the valve 31 is open. At this point, the flow of the viscous material 23 out of the cylinder 8 is completely shut off, and the user will know the cylinder 8 must be recharged with the viscous material 23. To recharge the container 8 with the viscous material 23, viscous material 23 will be pumped back into the cylinder 8 through the same bottom opening 28. This rising tide of viscous material 23 will push the boat 16 back up to nearly the top 14 of the cylinder 8. When the cylinder 8 is recharged with the viscous material 23, the viscous material 23 can again be delivered as described above.

The rounded bottom 16 of the boat 16 conforms fairly well to boat 16 to push a great majority (about 97 percent) of the viscous material 23 out of a 22 gallon cylinder. In contrast, conventional pusher plate systems generally deliver less than 90 percent of their contents.

Because the seal between the boat 16 and cylinder's sidewalls 10 is formed by the viscous material 23 on the inside of the sidewalls 10 of cylinder 8 and the slightly spaced away perimeter interface region 26 of the boat 16, there is little problem with the viscous material 23 backing up and piling onto the upper hull portion 22 of the boat 16, and back filling into the gas filled region 25 above the rising and falling pressuring boat 16. Depending on the particular viscous material 23 being utilized in the system, a thin layer of viscous material 23 may remain on the sidewalls 10 of the cylinder 8. However, this does not pose a problem because (a) the nitrogen gas prevents the viscous material from oxidizing and drying out, and (b) no scraping takes place. The system of the invention functions exceedingly well for greases having a thick consistency, such as greases with a National Lubricating Grease Institute (NLGI) rating of 0, 1, 2, and higher, and greases and other materials having a thick consistency which is not readily pourable. However, since most thick greases have about the same specific gravity, a pressuring boat, if adjusted with the proper ballast 20 for one grease will function well for most greases.

FIG. 6 is a view of an alternate embodiment of a floating boat 32. In this floating boat 32, the curved upper hull 34 and lower hull 36 join at a cylindrical intermediate section 38. A plurality of fins 40, instead of coming to a single point, can have a thin, flat, blade shape with an edge 42. The fins 40 attach along the cylindrical intermediate section 38. A weep hole 42 is provided at the top of the upper hull 34 to allow gas to enter the floating boat 32. This floating boat 32 is completely resistant to being fliped over in case the cylinder accidentally is knocked over.

In contrast with the instantly claimed invention, the systems of the prior art sought to achieve a very close fit between the inner cylinder walls and drum/pusher plates. The approach of prior art approaches is too sensitive to disruption and damage, i.e. if the cylinder or drum is dented or warped slightly out of round, then the pusher plate gets locked up. Welded steel drums are rarely perfectly cylindrical. Also, with the prior art pusher plate system, the top of the pusher plate invariably piles up with backed up grease. Eventually, the drum must be opened up and cleaned out. Doing so, in many cases, will render the product unusable, i.e. in the case where the atmosphere is dirty (i.e. coal mines), or where the product is sensitive to contamination and/or air (i.e. food/pharmaceutical products). Even if the product is not harmed, the cleaning of the drum takes additional time and is messy.

The invention uses nitrogen gas as the motive force since it is non-drying, is inexpensive, is inert, and does not dissolve into solution of the viscous material, for example, carbon dioxide does. Other inert gases, such as helium and argon would also function, but these are far more costly. A working pressure range of 20 to 120 psi works well for most thick, viscous materials, with the optimal pressure range being decided depending on the particular viscous material.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances amy suggest or render expedient; and although specific terms have been employed, they are intended in a generic and descriptive sense only and not for the purpose of limitation, the scope of the invention being delineated in the following claims:

I claim:

1. A reusable viscous material dispensing apparatus for use in dispensing thick, viscous materials, comprising:

a sealed pressure container having sidewalls of generally cylindrical shape, an inert gas inlet at a top region, and a viscous material ingress and egress opening at a bottom region; and a pressurizing boat located inside said sealed pressure container, said pressurizing boat having a lower, hull portion and an upper hull portion, the largest cylindrical diameter of said pressurizing boat being less than the internal cross-sectional diameter of the cylindrical sealed pressure container, said pressurizing boat having means to prevent said largest cylindrical diameter of said pressurizing boat from directly contacting the inside of the sidewalls of the cylindrical container, wherein in use of the system the container is filled with a viscous material through its ingress and egress opening which raises the pressurizing boat in the sealed pressure container and forms a viscous material seal between the largest diameter of the pressurizing boat and the inside of the sidewall of the container, and by applying inert gas pressure to the pressurizing boat from above, the pressurizing boat will force the viscous material out of the container through the viscous material ingress and egress opening.

2. The reusable viscous material dispensing apparatus of claim 1, wherein the pressurizing boat is weighted so that the weight of viscous material displaced by its lower hull portion is about equal to the weight of the pressurizing boat.

3. The reusable viscous material dispensing apparatus of claim 2, wherein the lower hull portion is weighted with ballast.

4. The reusable viscous material dispensing apparatus of claim 1, wherein the lower region of the sealed pressure container is rounded and the lower hull portion of the pressurizing boat is also rounded, and has a seating surface for seating on the viscous material ingress and egress opening to shut off flow of viscous material when the cylinder is substantially depleted of viscous material.

5. The reusable viscous material dispensing apparatus of claim 1, wherein the upper portion of the boat is rounded, and has an opening formed therein to permit the space inside the pressurizing boat to be pressurized with the inert gas.

6. The reusable viscous material dispensing apparatus of claim 1, wherein the means to prevent the largest cylindrical diameter of the pressurizing boat from contacting the inside of the cylinder's sidewalls comprises a plurality of fins extending outwardly from the vicinity of the interface region of the pressurizing boat, said fins having terminating points which generally do not make contact with the inside surface of the sidewalls of cylinder, and if they do, only make a slight scrap line on the viscous material on the inside of the sidewalls of the cylinder, which scrap lines are readily filled in.

7. The reusable viscous material dispensing apparatus of claim 1, wherein the inert gas is nitrogen, in a pressure range of about 20 to 120 pounds per square inch.

8. The reusable viscous material dispensing apparatus of claim 1, wherein valve means is placed downstream of the viscous material ingress and egress opening to control the flow of the viscous material.

9. The reusable viscous material dispensing apparatus of claim 1, wherein the pressure cylinder is connected to a constant source of inert gas to maintain the inert gas at a relatively constant pressure in the cylinder.

10. The reusable viscous material dispensing apparatus of claim 1, wherein the pressure cylinder is pressurized with a predetermined quantity of inert gas, which will serve to expel repeated cylinder's full of viscous material out of the cylinder.

11. The reusable viscous material dispensing apparatus of claim 1, wherein the viscous material used is highly viscous industrial and motor vehicle lubricant.

12. The reusable viscous material dispensing apparatus for use in dispensing thick, viscous materials, comprising:

a sealed pressure cylinder having a cylindrical body with sidewalls, a generally hemispherical upper end with an inert gas inlet, and a generally hemispherical lower end with an ingress and egress opening; and a pressurizing boat contained inside the sealed pressure cylinder, said pressurizing boat having a lower, hull portion which is generally rounded in shape to conform to the shape of the generally hemispherical lower and of the pressure cylinder and an upper portion which is generally rounded in shape to conform to the shape of the generally hemispherical upper end of the pressure cylinder, said upper portion having a small orifice formed in a top portion thereof, said upper portion and lower, hull portion being connected together along a circular interface region which is smaller in diameter than the internal cross-sectional diameter of the cylindrical pressure container, said boat being weighted in its hull portion so that the weight of the viscous material displaced by its lowered, hull portion is about equal to the weight of the entire pressurizing boat, so that the pressurizing boat will float in the viscous material with the viscous material coming up to about its interface region, said boat further having a plurality of fins extending radially outwardly from the vicinity of the interface region, said fins having narrow terminating points which generally do not make contact with the inside surface of the sidewalls of the cylinder, and if they do, only make a slight scrape line of the viscous material on the insides of the sidewalls of the cylinder, which scrape lines are readily filled in, wherein in the use of the system, the cylinder is filled with viscous material through its ingress and egress opening, which raises the pressurizing boat in the pressure cylinder and forms a viscous material seal between the interface region and its fins, and the inside of the sidewalls of cylinders, and by applying inert gas pressure to the pressurizing boat from above, the pressurizing boat will force the viscous material out of the container through the viscous material ingress and egress opening, all the while maintaining the seal between the pressuring boat and the inside of the sealed pressure cylinder.

13. The reusable viscous material dispensing apparatus of claim 12, wherein the inert gas is nitrogen gas at a pressure range of about 20 to 120 pounds per square inch.

14. The reusable viscous material dispensing apparatus of claim 12, wherein a bottom surface of the pressurizing boat will seat on the viscous material ingress and egress opening, and seal it off when the pressure cylinder is almost completely depleted of the thick, viscous material.

15. The reusable viscous material dispensing apparatus of claim 12, wherein the pressure cylinder is pressurized with a predetermined quantity of inert gas, which will serve to expel repeated cylinder's full of the thick viscous material out of the cylinder.

16. The reusable viscous material dispensing apparatus of claim 12, wherein the pressure cylinder is connected to a constant source of inert gas to maintain the inert gas, at a relatively constant pressure in the cylinder.

* * * * *